US006089074A

United States Patent [19]

Dorsett

[11] Patent Number: 6,089,074

[45] Date of Patent: Jul. 18, 2000

[54] PRESS

[75] Inventor: Michael William Dorsett, Surrey, United Kingdom

[73] Assignee: D.V. Automation Ltd., Surrey, United Kingdom

[21] Appl. No.: 09/312,522

[22] Filed: May 14, 1999

[30] Foreign Application Priority Data

May 14, 1998 [GB] United Kingdom ..... 9810366

[51] Int. Cl.[7] ..... B21D 39/02; B21J 9/18

[52] U.S. Cl. ..... 72/450; 72/319; 72/323; 72/403; 29/243.58

[58] Field of Search ..... 72/323, 319, 314, 72/315, 312, 450, 405, 451; 29/243.58

[56] References Cited

U.S. PATENT DOCUMENTS

| | | | |
|---|---|---|---|
| 4,706,489 | 11/1987 | Dacey, Jr. | 72/450 |
| 5,005,398 | 4/1991 | Evans | 72/450 |
| 5,050,422 | 9/1991 | Dorsett . | |
| 5,083,355 | 1/1992 | Dacey, Jr. | 29/243.58 |
| 5,272,903 | 12/1993 | Evans | 72/403 |
| 5,457,981 | 10/1995 | Brown et al. | 72/403 |

FOREIGN PATENT DOCUMENTS

| | | |
|---|---|---|
| 8909100 | 10/1989 | WIPO . |
| 8909101 | 10/1989 | WIPO . |
| 9305902 | 4/1993 | WIPO . |

*Primary Examiner*—David Jones
*Attorney, Agent, or Firm*—Baker Botts L.L.P.

[57] ABSTRACT

The press comprises a first generally-horizontal link (L1) below a second generally-horizontal link (L2). A third link (L3) extends down from the second link to the first link and carried a press tool (70) with a generally downwardly facing working surface. A fourth link (L4) is arranged to be driven by a first mechanism (DS, M2) to push the second link and thus the press tool generally forwards from a horizontally retracted start position to a horizontally advanced initial pressing position, after which the first mechanism is arranged to hold the position of the fourth link. A second mechanism (DS, C, L5) is arranged, when the position of the fourth link is being held, to pivot the first link to drag downwards the third link and thus drag the press tool generally downwards from the initial pressing position to a vertically lower final pressing position.

18 Claims, 7 Drawing Sheets

PRESS

This invention relates to a press tool and a drive mechanism, and in particular, but not exclusively, is concerned with what is known as the "hemming" of panels, such as automotive body panels.

FIGS. 1A and 1C of the accompanying drawings illustrate hemming of inner and outer panels. The marginal edge 30 of an outer panel 32 (part of which is shown) is initially upturned at about 90°, as shown in FIG. 1A, and is fixed in a jig. An inner panel 34 is then placed over the outer panel 32 and is fixed in the jig, such that the outer edge 36 of the inner panel 34 sits close to the bend between the outer panel 32 and its marginal edge 30. In the "pre-hemming" operation, the marginal edge 30 is bent over at approximately 45°, as shown in FIG. 1B. Then, in a "final hemming" operation, the marginal edge 30 of the outer panel 32 is pressed down flat under great pressure against the outer edge 36 of the inner panel 34, as shown in FIG. 1C.

The movement of the pre-hem tool is important. If the panel were to have straight edges, then movement of the tool in the direction marked 38 in FIG. 1B might be acceptable. However, many body panels have curved edges and in these cases it is desirable to use a curved pre-hem tool to pre-hem a large extent of a curve. However, if the tool moved in a direction 38 in the plane of the paper of FIG. 1B at one location along the edge of the panel, at other locations the movement would be inclined relative to the plane of the paper of FIG. 1B, and there would be undesirable movement between the tool and the marginal edge 30, which would produce an unsatisfactory result. For a good result, it is desirable that the pre-hem tool moves vertically, as shown by arrow 40 in FIG. 1B.

WO89/09101 discloses a press with a pre-hem tool and a final hem tool. The pre-hem tool is mounted on a parallelogram linkage, and the motion of the pre-hem tool at its final pressing position is in a forward and downward direction at an angle of approximately 60° to the vertical. A similar arrangement of pre-hem tool is also disclosed in WO93/05902.

WO89/09100 discloses a press having a tool which is mounted on a generally-parallelogram linkage. The two parallel links are generally horizontal. The lower parallel link has a fixed pivot point at one end and a pivot point at the other end that is raised up and down by a piston. The upper parallel link is connected at one end to the connecting link of the linkage, and at its other end has a pivot point which is raised up and down by a piston, so as to have the effect of producing mainly horizontal movement of the tool which is carried by the connecting link.

WO89/09103 discloses a press having a tool which is mounted on a parallelogram linkage of four links. The upper parallel link is pivoted to produce vertical movement of the press tool. The lower parallel link is pushed by a driver link to produce a horizontal movement of the press tool.

According to a first aspect of the present invention, there is provided a press comprising:

a first link pivoted about a first fixed pivot point;

a second link pivoted about a second pivot point;

a third link pivoted about third and fourth pivot points on the first link and second link, respectively;

a press tool mounted on the third link;

a fourth link pivoted about a fifth fixed pivot point and the second pivot point;

a first mechanism arranged to pivot the fourth link so as to move the second link and thereby pivot the third link about the third pivot point to move the press tool and then to hold the position of the fourth link with the first, second, third and fourth pivot points having generally the configuration of a parallelogram; and a second mechanism arranged to pivot the first link about the first fixed pivot point to move the press tool.

Preferably, the first and second mechanisms are synchronised so that, when the first mechanism is arranged to hold the position of the fourth link, the second mechanism is arranged to pivot the first link about the first fixed pivot point to move the press tool. In this way, the press is provided with two distinct phases of operation: a first phase in which the first mechanism operates and a second phase in which the first mechanism does not operate and the second mechanism does operate.

Preferably, when the first to fourth pivot points have the generally parallelogram configuration, the press tool is movable by the second mechanism from an initial pressing position to a final pressing position in which the line from the first to third pivot points forms an angle relative to the horizontal of substantially 0 to 40°.

With the line from the first to third pivot points having an angle relative to the horizontal of substantially 0 to 40°, the movement of the press tool as it approaches the final pressing position will correspondingly be at an angle of 0 to 40° to the vertical. Usually, the closer the terminal movement is to the vertical direction, the better. For this reason, the line from the first to third pivot points may form an angle relative to the horizontal of substantially 0 to 30°, more preferably 0 to 15° and more preferably still substantially 0°.

In the preferred embodiment, the fourth link has a first cam element and the first mechanism comprises a second cam element for driving the first cam element. Usually, the first cam element is a cam follower, and the second cam element is a cam rotatable about a cam axis and having a first portion of cam surface of varying radius relative to the cam axis for pivoting the fourth link and a second portion of cam surface of substantially constant radius relative to the cam axis for holding the position of the fourth link. Thus, the first portion of cam surface may be used to move the press tool from a start position to the initial pressing position. Whilst the second portion of cam surface is holding the position of the fourth link, the second mechanism may be used to move the press tool from the initial pressing position to the final pressing position.

Preferably, the cam has a third portion of cam surface of varying radius relative to the cam axis for partially or totally reversing the pivoting of the fourth link caused by the first portion of cam surface. The third portion of cam surface may be used to retract the press tool from the final pressing position to a rest position out of the way of, for example, the path of movement of a further press tool.

In the preferred embodiment, the second mechanism comprises a fifth link pivoted to the first link at a sixth pivot point and a crank pivoted to the fifth link at a seventh pivot point and rotatable about a crank axis.

It is preferred that the first and second mechanisms are driven by a common drive shaft. This makes the cam axis the same as the crank axis and produces an economical arrangement of the press, and also simplifies the synchronism of the movements of the first and second mechanisms. Conveniently, the drive shaft is driven by an electric motor. This simplifies the initial construction and subsequent operational running of the press.

According to a second aspect of the present invention, there is provided a press comprising:

a first generally-horizontal link below a second generally-horizontal link;

a third link extending down from the second link to the first link and carrying a press tool with a generally downwardly facing working surface;

a fourth link arranged to be driven by a first mechanism to push the second link and thus the press tool generally forwards from a horizontally retracted start position to a horizontally advanced initial pressing position, after which the first mechanism is arranged to hold the position of the fourth link; and a second mechanism arranged, when the position of the fourth link is being held, to pivot the first link to drag downwards the third link and thus drag the press tool generally downwards from the initial pressing position to a vertically lower final pressing position.

In the preferred embodiments, the press is a pre-hemming press and the press tool is a pre-hemming press tool. However, the invention may be applied to other types of press.

A non-limiting embodiment of a press according to the present invention will now be described with reference to the accompanying drawings, in which.

Figure 2A:
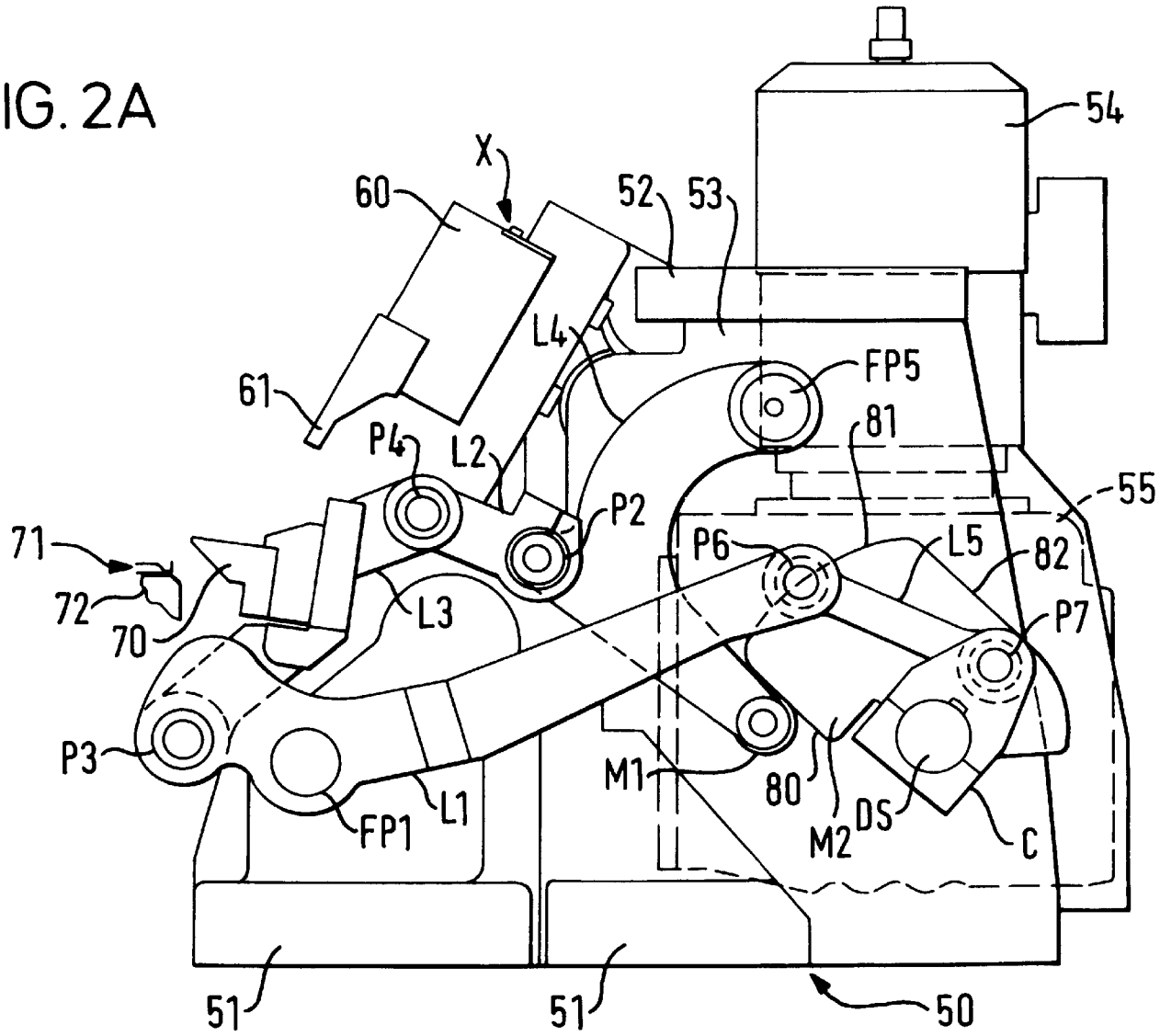
FIG. 2A is a side view of a press according to the present invention and shows a press tool at a start position.
Figure 2B:
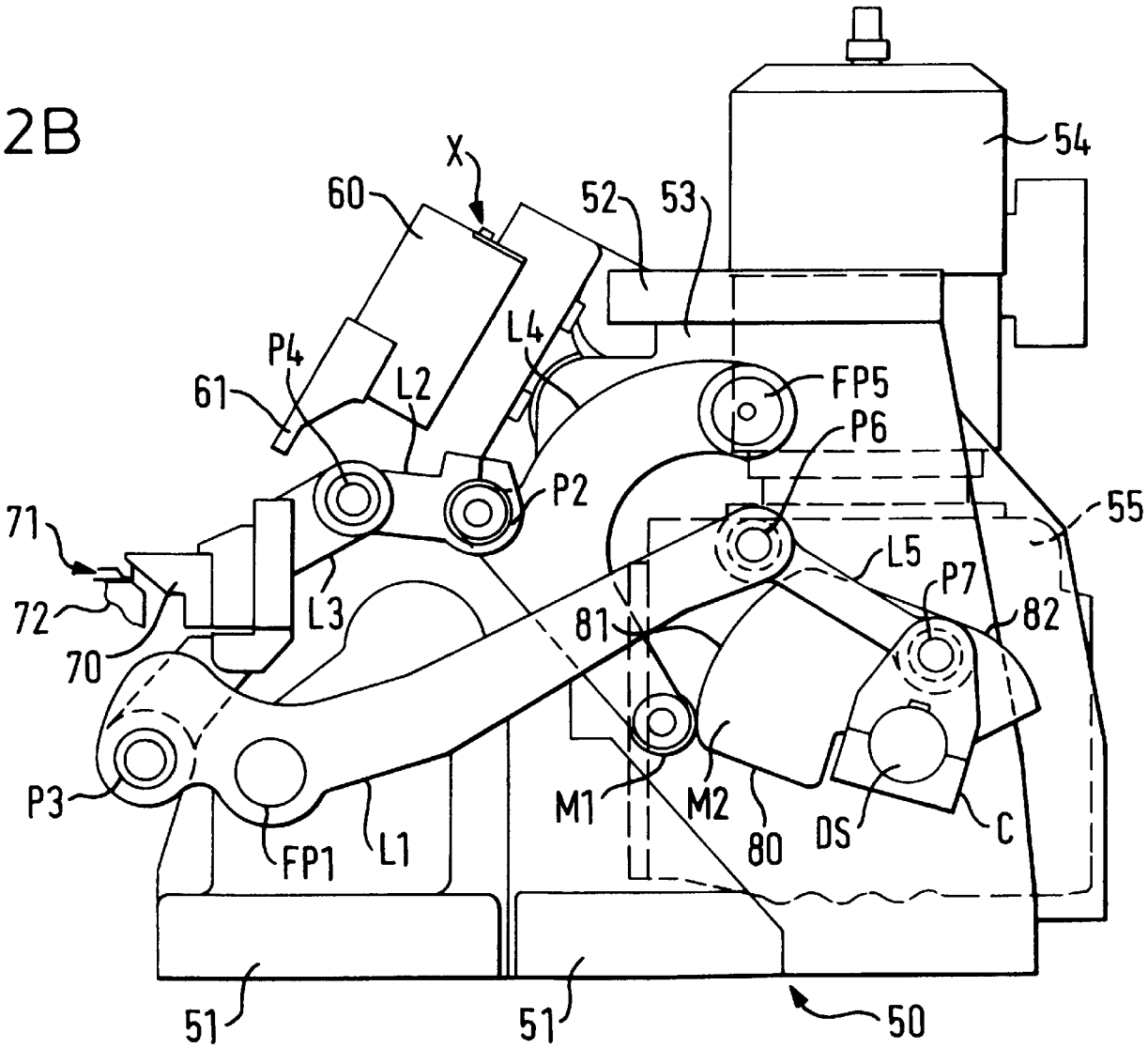
FIG. 2B is a side view of the press of FIG. 2A and shows the press tool at an initial pressing position.
Figure 2C:
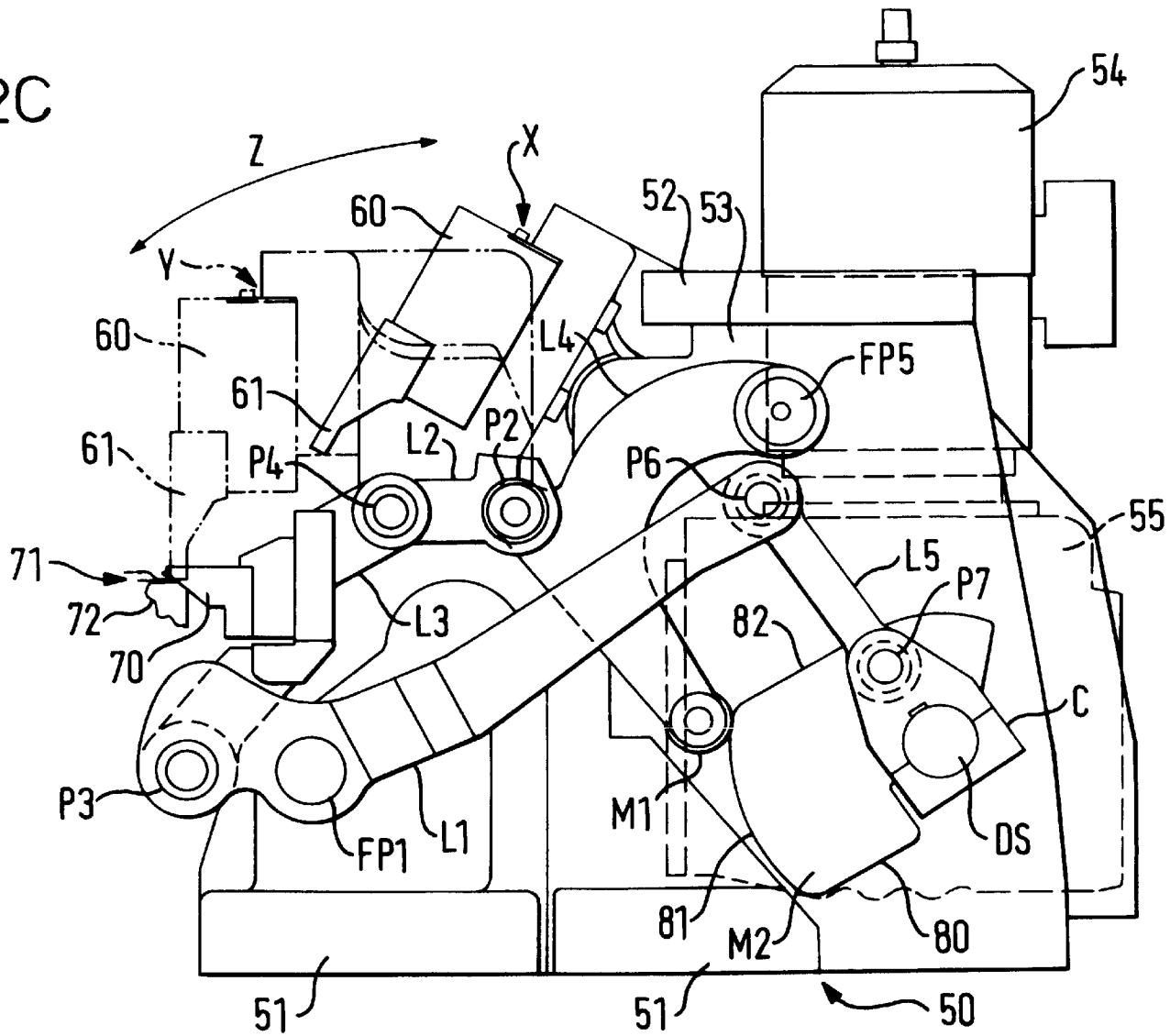
FIG. 2C is a side view of the press of FIG. 2A and shows the press tool at a final pressing position.

The press of the embodiment is shown in side view in FIGS. 2A–2C and is capable of performing a pre-hemming operation and a final hemming operation. The moveable components are supported on a stand or frame 50 which comprises several base portions 51 and a top wall 52 which extend between two side walls 53, only one of which is visible in FIGS. 2A–2C.

The stand 50 also carries an electric motor 54 which drives a gearbox 55 having a drive shaft DS as an output.

The components of the press for performing the final hemming operation are mounted between the side walls 53. These components are not shown or described in any detail as they are in accordance with the final hemming components of WO93/05902, which is incorporated herein by reference, and are driven by the drive shaft DS. To aid comprehension, FIG. 2C shows the head 60 with its final hem tool 61 at a retracted rest position X and at an advanced working position Y. The movement Z between positions X, Y is produced by rotation of the drive shaft DS.

Figure 1A:
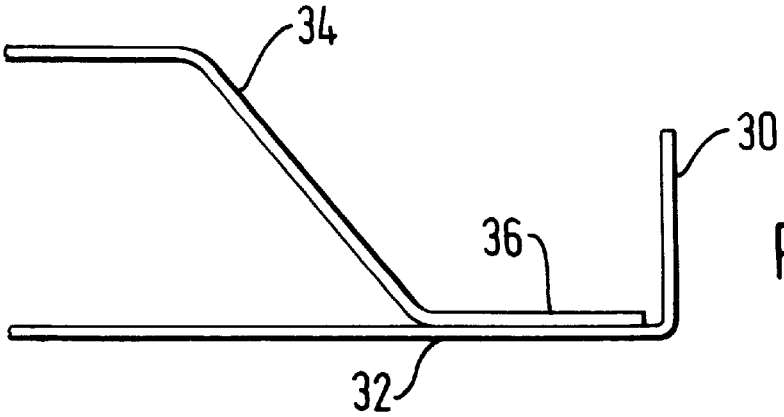
FIG. 1A is a side view of inner and outer panels before any hemming operation.
Figure 1B:
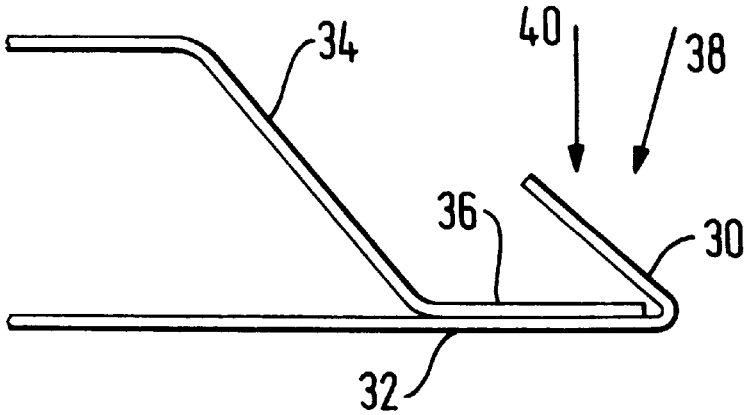
FIG. 1B is a side view of the panels of FIG. 1A after a pre-hemming operation.
Figure 1C:
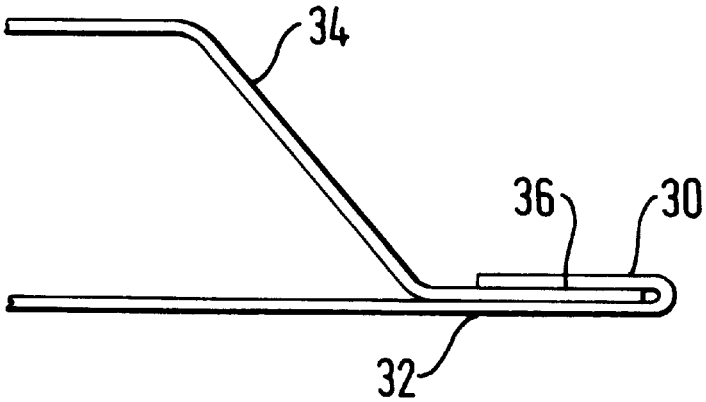
FIG. 1C is a side view of the panels of FIG. 1B after a final hemming operation.

A pre-hem tool 70 is arranged to perform the pre-hemming operation on a workpiece 71 (difficult to see in FIG. 2A) which is generally as shown in FIG. 1A and is firmly supported on a block 72 (only a small part of which is shown). After the pre-hem tool 70 has performed its pre-hemming operation, the final hem tool 61 moves in to perform the final hemming operation.

The pre-hem tool 70 is carried by a linkage mechanism. A first link L1 is fixedly pivoted on the stand 50 at a first fixed pivot point FP1 and is a first order lever having a generally bell-crank shape. A second link L2 is positioned above the first link L1 and is arranged to pivot about a second pivot point P2. A third link L3 is pivoted to the first link L1 at a third pivot point P3 in front of the first fixed pivot point FP1. The third link L3 extends up to the second link L2 and is pivoted thereto at a fourth pivot point P4 in front of the second pivot point P2. The pre-hem tool 70 is rigidly fixed to the third link L3.

It can be seen that the first to fourth pivot points FP1, P2, P3, P4 have a quadrilateral configuration and are actually configured, as shown in FIGS. 2B and 2C, having a parallelogram configuration. The distance between the pivot axes of the first and third pivot points FP1, P3 is the same as the distance between the pivot axes of the second and fourth pivot points P2, P4.

There is no link connecting the first and second pivot points FP1, P2 and the position of the second pivot point P2 is controlled by a fourth link L4. The fourth link L4 is fixedly pivoted to the stand 50 at a fifth fixed pivot point FP5 and is a second order lever which is generally L-shaped and receives its input force via a cam follower M1 positioned at the opposite end of the lever to the fifth fixed pivot point FP5. The fourth link L4 controls the position of the second pivot point P2 and thereby controls the configuration of the first to fourth pivot points FP1–P4 and also provides most of the horizontal movement of the pre-hem tool 70 between retracted and forward positions.

The cam follower M1 is driven by a cam M2 which rotates with the drive shaft DS. From a start position shown in FIG. 2A, the cam M2 rotates anti-clockwise and the cam follower M1 rides up a first portion 80 of cam surface of increasing radius so as to have the effect of moving the cam follower M1 from the position shown in FIG. 2A to the position shown in FIG. 2B. During the anti-clockwise rotation of the drive shaft DS and the cam M2, the cam follower M1 passes from the first portion 80 of cam surface onto a second portion 81 of cam surface which has a constant radius relative to the axis of rotation of the drive shaft DS. Consequently, during the next phase of the rotation of the cam M2, no further movement is imparted to the cam follower M1 and thus the position of the fourth link L4 is held. The end of the second portion 81 of cam surface corresponds to the pre-hem tool 70 reaching its final pressing position and finishing the pre-hemming operation. In order to retract the pre-hem tool 70, to permit operation of the final hem tool 61, the cam M2 also includes a third portion 82 of cam surface of decreasing radius so as to cause the fourth link L4 to rotate anti-clockwise about the fifth fixed pivot point FP5 (as viewed in FIG. 2C) in order to retract the pre-hem tool 70 to the right (as viewed in FIG. 2C) from the final pressing position to a rest position.

To get the cam follower M1 to pass over the three portions 80–82 of cam surface involves the drive shaft DS rotating the cam M2 anti-clockwise through approximately 180°. After the final hemming operation has been performed, the press is returned to its initial configuration by reversing the direction of rotation of the drive shaft DS so that the drive shaft DS rotates clockwise through 180° to return the pre-hem tool 70 from its rest position to its start position.

The first link L1 is driven by a crank C via a fifth link L5 which is pivoted to the first link L1 at a sixth pivot point P6 and to the crank at a seventh pivot point P7. The crank C is fixed to the drive shaft DS for rotation therewith. Thus, there is synchronism between the crank C and the cam M2 by virtue of the fact that they are both fixed to and rotated by the drive shaft DS.

As shown in FIGS. 2A–2C, the first to fifth links L1–L5, cam M2 and crank C form a first set of press components which are mounted on the outside of the side wall 53 visible in FIGS. 2A–2C. As previously explained, there is a second side wall 53 positioned behind the side wall 53 shown in FIGS. 2A–2C, as viewed in those figures. On the outer surface of the second side wall 53 there is a second set of press components duplicating the first to fifth links L1–L5, cam M2 and crank C. Both cams M2 and both cranks C are driven by the same drive shaft DS which extends across the full width of the press. The two third links L3 are actually respective halves of a single long link which extends across the full width of the press. The pre-hem tool 70 also extends across the full width of the press and is supported on the single long link which comprises the third links L3 of the two sets of press components.

The cycle of movement of the pre-hem tool 70 starts off with it positioned in the horizontally retracted start position shown in FIG. 2A. It then moves forwards and slightly downwards to an initial pressing position at which it is positioned to start the pre-hem pressing operation. The initial pressing position is shown in FIG. 2B. The pre-hem tool 70 then moves downwards to the final pressing position and, in so doing, it performs the pre-hemming operation. The final pressing position is shown in FIG. 2C. Then, the pre-hem tool retracts backwards (to the right in FIG. 2C) and upwards to a rest position at the end of the cycle. This rest position is the same as the start position. When the pre-hem tool 70 is in its rest position, the final hem tool 61 driven by the drive shaft DS is free to move downwards onto the workpiece 71 to follow the pre-hemming operation with a final hemming operation. By reversing the direction of rotation of the drive shaft DS from anti-clockwise to clockwise, the pre-hem tool 70 is returned from its rest position to its start position, through the final pressing position and initial pressing position. The workpiece 71 can then be replaced with a fresh workpiece, and the cycle of operation commenced again.

At the beginning of the cycle of operation (see FIG. 2A), the cam follower M1 is resting on the start (small diameter portion) of the first portion 80 of cam surface of the cam M2.

As the drive shaft DS starts to rotate anti-clockwise, the cam follower M1 rides up onto the second portion 81 of the cam M2. This rotates the fourth link L4 clockwise about the fifth fixed pivot point FP5, thereby moving the second pivot point P2. The second link L2 is therefore pushed generally forwards (to the left in FIG. 2A) so as to rotate the third link L3 about the third pivot point P3 and thereby push the pre-hem tool 70 forwards from its start position. At the same time, the anti-clockwise rotation of the drive shaft DS is also rotating the crank C anti-clockwise. Consequently, the fifth link L5 pushes the sixth pivot point P6 upwards. This rotate the first link L1 anti-clockwise about the first fixed pivot point FP1, thereby lowering the third pivot point P3. At this point in time, the third pivot point P3 is still above the horizontal, so that the anti-clockwise rotation of the first link L1 contributes to a small extent to the moving forwards of the pre-hem tool 70, although the main effect of the anti-clockwise rotation of the first link L1 is to move the pre-hem tool downwards.

At this stage in the cycle of operation, the pre-hem tool 70 has moved from its start position generally forwards and slightly downwards to its initial pressing position (see FIG. 2B) in which the generally-downwardly facing tool face of the pre-hem tool 70 is positioned just above the workpiece 71.

Also, by the time that the pre-hem tool 70 is in the initial pressing position shown in FIG. 2B, the first to fourth pivot points FP1–P4 have been given a parallelogram configuration, by virtue of the positioning of the second pivot point P2 by the fourth link L4, and this parallelogram configuration is held by the fourth link L4 for the duration of the movement from the initial pressing position to the final pressing position.

Further anti-clockwise rotation of the drive shaft DS causes the cam follower M1 to ride along the second portion 81 of the cam M2. Because the second portion 81 of the cam M2 is of constant radius relative to the axis of rotation of the drive shaft DS, no movement is imparted to the cam follower M1 during this phase of the cycle of operation. Consequently, the position of the fourth link L4 is held, thereby holding the position of the second pivot point P2 and also holding the parallelogram configuration of the first to fourth pivot points FP1–P4. Whilst the position of the fourth link L4 is being held, the crank C rotates further anti-clockwise, thereby imparting further anti-clockwise rotation to the first link L1. Thus, the third pivot point P3 drags downwards the third link L3 and the pre-hem tool 70 fixed thereto. The pre-hem tool 70 therefore moves from its initial pressing position shown in FIG. 2B along a circular arc to its final pressing position shown in FIG. 2C and, in so doing, performs the pre-hemming operation on the workpiece 71. Thus, it may be seen that, during this phase of the cycle of operation, the movement of the pre-hem tool 70 is caused only by the crank C and not by the cam M2.

The positions of the press components with the pre-hem tool 70 in its final pressing position are shown in FIG. 2C. It may therefore be seen that, at the final pressing position, in addition to the line from the first pivot point FP1 to the third pivot point P3 being parallel to the line from the second pivot point P2 to the fourth pivot point P4 by virtue of the parallelogram configuration of the first to fourth pivot points FP1–P4, these two lines are also horizontal. Consequently, although the pre-hem tool moves along a circular arc as it moves from its initial pressing position to its final pressing position, its movement as it approaches the final pressing position will be vertical.

As the final pressing position is approached, the seventh pivot point P7 moves into alignment with the drive shaft DS and sixth pivot point P6 so as to give the crank C a good mechanical advantage in moving the sixth pivot point P6. Furthermore, in view of the fact that the length of the arm of the first link L1 from the first fixed pivot point FP1 to the sixth pivot point P6 is considerably longer than the length of the arm of the first link L1 from the first fixed pivot point FP1 to the third pivot point P3, the force applied to the sixth pivot point P6 is amplified into a considerably greater force that is used to pull downwards the third link L3 and the pre-hem tool 70.

During the next phase of the cycle of operation, the cam M2 starts to have some effect in addition to the crank C continuing to have effect. Specifically, the cam follower M1 rides down the third portion 82 of the cam M2. The fourth link L4 therefore pivots anti-clockwise about the fifth fixed pivot point FP5, thereby releasing the holding or fixing effect on the second pivot point P2 that applied during the previous phase of the cycle of operation. The second pivot point P2 moves backwards (to the right in FIG. 2C) and downwards and has the effect of dragging the second link L2 generally backwards, so as to pivot the third link L3 clockwise about the third pivot point P3. This movement of the third link L3 retracts the pre-hem tool 70 away from the block 72 on which the workpiece 71 is mounted.

At the same time, the anti-clockwise rotation of the drive shaft DS moves the seventh pivot point P7 past the position in which it is aligned with the drive shaft DS and sixth pivot point P6. Consequently, the sixth pivot point P6 is pulled downwards and the first link L1 rotates clockwise. This lifts the third pivot point P3 and contributes to lifting the pre-hem tool 70 from the final pressing position to the rest position at the end of the cycle of operation of the pre-hem tool. As the third pivot point P3 rises upwards, the line connecting the first fixed pivot point FP1 to the third pivot point P3 ceases to be horizontal and consequently the rotation of the first link L1 starts to contribute to a small extent to the backward movement of the pre-hem tool 70, although the main effect of the rotation of the first link L1 is to lift the pre-hem tool upwards.

When the pre-hem tool 70 is clear of the workpiece 71, the final hem head 60 with the final hem tool 61 is driven by the drive shaft DS to move from its rest position X to its working position Y along the path of movement Z so as to perform a final hemming operation on the workpiece 71.

Now that the cycle of operation is complete, the direction of rotation of the drive shaft DS is reversed and it starts to rotate clockwise to return all components to their start positions.

The construction of the press shown in FIGS. 2A–2C is such that, as the pre-hem tool 70 approaches the final pressing position, the line from the first fixed pivot point FP1 to the third pivot point P3 and the line from the second pivot point P2 to the fourth pivot point P4 both become horizontal, so that the movement of the pre-hem tool 70 along its circular arc becomes vertically downwards. If such terminal movement of the pre-hem tool is not needed or is not possible (e.g. because the pre-hem tool would clash with some other components), then the construction may be varied to provide terminal movement to the final pressing position which is at an angle to the vertically downward direction. For example, in FIG. 2D, there is shown a modification in which the third pivot point P3 is positioned at a position rotated clockwise through 15° about the first fixed pivot point FP1, relative to the position used in the embodiment of FIGS. 2A–2C. In FIG. 2D, the start and rest positions of the pre-hem tool are shown in dash and single-dot line. The initial pressing position is shown in dotted line, and the final pressing position of all components is shown in solid line.

At the initial pressing position of the pre-hem tool 70, and through to the final pressing position, the position of the second pivot point P2 is again held so that the first to fourth pivot points FP1–P4 will have a parallelogram configuration. Consequently, the pre-hem tool 70 moves along a circular arc. However, because of the revised position of the third pivot point P3, the terminal movement of the pre-hem tool 70 as it approaches the final pressing position will be along a path which is at an angle of 15° to the vertical. This is because, at the final pressing position, the line from the first fixed pivot point FP1 to the third pivot point P3 and the line from the second pivot point P2 to the fourth pivot point P4 will both slope upwards at an angle of 15° to the horizontal.

Figure 2E:
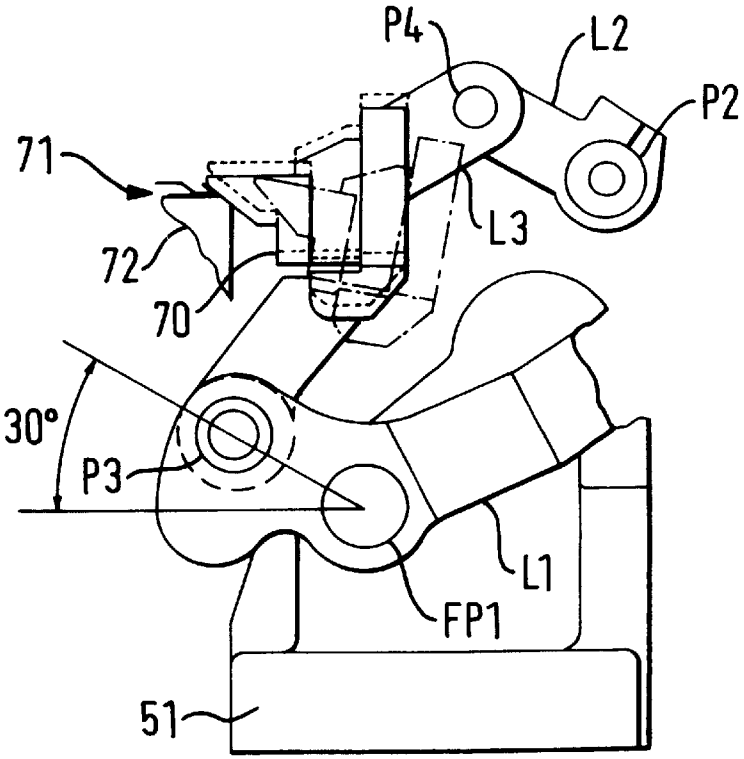
FIG. 2E shows a further modification to the press of FIGS. 2A–2C.
Figure 2D:
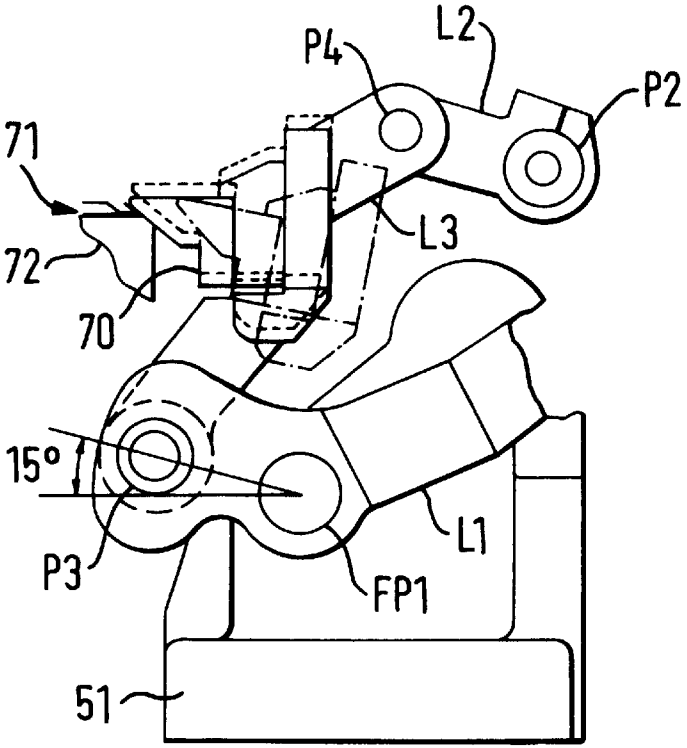
FIG. 2D shows a modification to the press of FIGS. 2A–2C.

In the further modification shown in FIG. 2E, the third pivot point P3 is positioned on the first link L1 at a position rotated through an angle of 30° about the first fixed pivot point FP1 relative to the positioning used in the main embodiment of FIGS. 2A–2C. Consequently, the terminal movement of the pre-hem tool 70 as it approaches the final pressing position will be at an angle of 30° to the vertical.

Figure 3C:
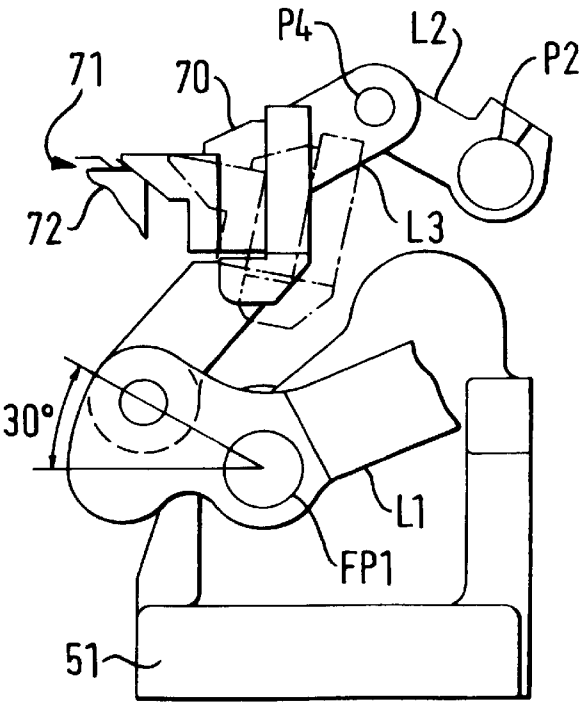
FIGS. 3A, 3B and 3C are side-by-side comparisons showing how the movement of the press tool to its final pressing position may be varied by varying the positioning of one of the pivot points in one of the links.
Figure 3B:
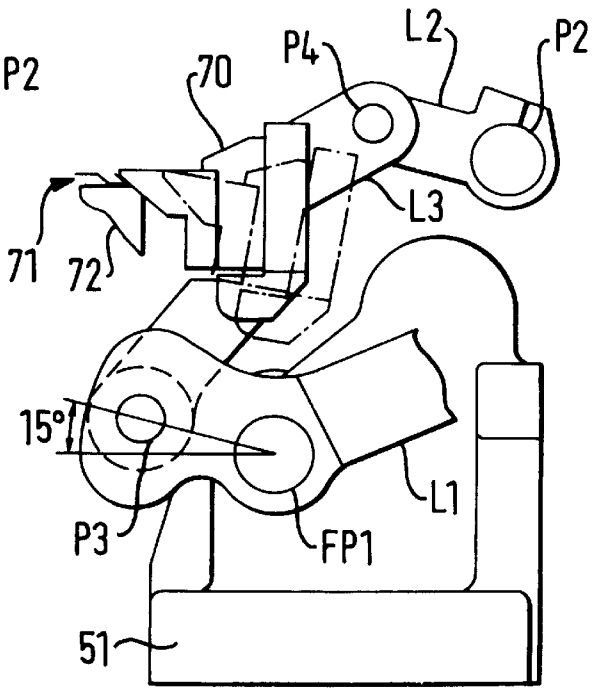
Figure 3A:
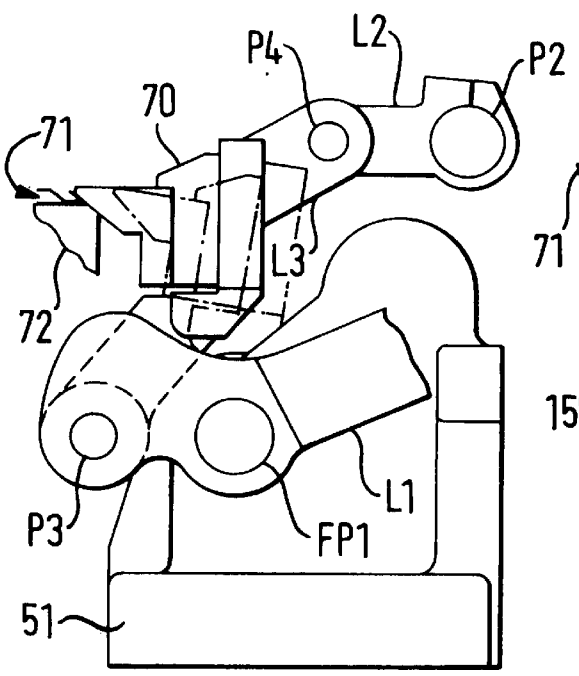

FIG. 3A, FIG. 3B and FIG. 3C provide a side-by side comparison of the effect of moving the position of the third pivot point P3 on the first link L1. They illustrate that the same first link L1 may be used for the three different versions, and that it is simply a matter of machining the position of the third pivot point P3 at different angular positions relative to the first fixed pivot point FP1. To accommodate the different machined positions, the end of the first link L1 is relatively bulbous so as to have sufficient metal available to accommodate the different desired positions of the third pivot point P3. When modifying the position of the third pivot point P3, no other modifications are required to the other components of the linkages and drive mechanisms that move the pre-hem tool 70.

In FIGS. 3A–3C, solid line is used to show component positions when the pre-hem tool 70 is at its final pressing position. The position of the pre-hem tool 70 in its start and rest positions is shown in dash and single dot line.

Figure 4A:
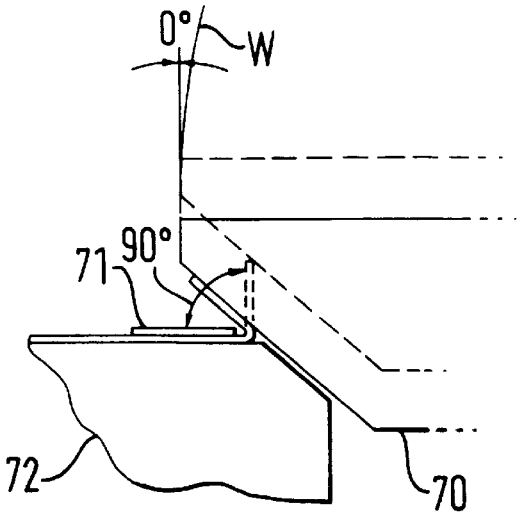
FIGS. 4A, 4B and 4C correspond respectively to FIGS. 3A, 3B and 3C and show in detail the movement of the press tool as it approaches the final pressing position.
Figure 4B:
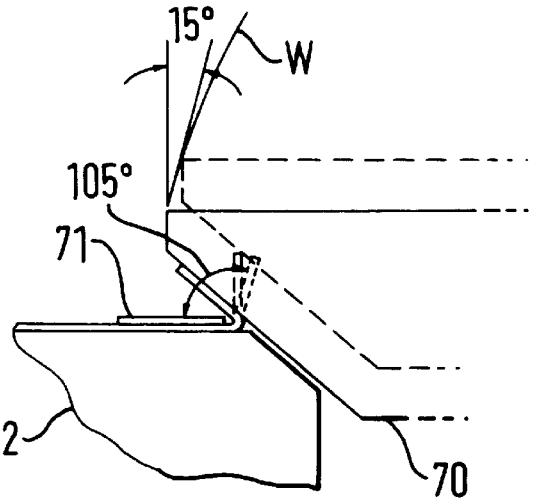
Figure 4C:
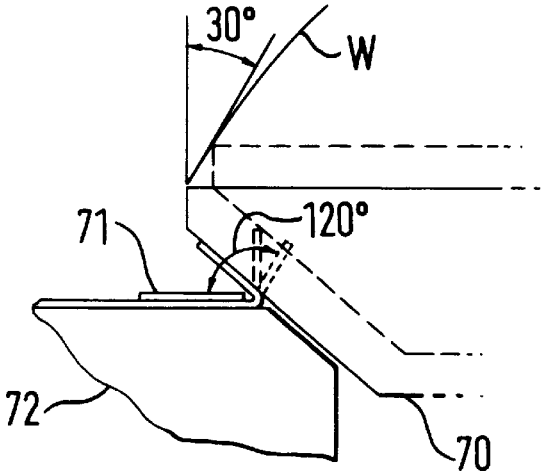

FIGS. 4A, 4B and 4C correspond respectively to FIGS. 3A, 3B and 3C and are enlarged views showing in detail the terminal movement of the pre-hem tool as it approaches its final pressing position. It may be seen that, for each of the three different arrangements, the pre-hem tool 70 moves along a path W which is a circular arc and that the terminal movement as it approaches the final pressing position is vertically downwards (FIG. 4A), at 15° to the vertical (FIG. 4B) or at 30° to the vertical (FIG. 4C).

The maximum open angle of the marginal edge of the outer panel of the workpiece 71 that can be pre-hemmed with the arrangement of FIGS. 3A and 4A is 90°. For the arrangement of FIGS. 3B and 4B, the maximum open angle is 105°. For the arrangement of FIGS. 3C and 4C, the maximum open angle is 120°. Thus, whilst terminal movement which is vertically downwards is desirable, particularly when the marginal edge of the outer panel is curved along its length (into and out of the plane of the paper of the Figures), this advantage can be sacrificed to have terminal movement which is at an angle to the vertical in order to be able to pre-hem a larger open angle of the marginal edge of the outer panel of the workpiece.

What is claimed is:

1. A press comprising:

a first link (L1) pivoted about a first fixed pivot point (FP1);

a second link (L2) pivoted about a second pivot point (P2);

a third link (L3) pivoted about third and fourth pivot points (P3, P4) on the first link and second link, respectively;

a press tool (70) mounted on the third link;

a fourth link (L4) pivoted about a fifth fixed pivot point (FP5) and the second pivot point;

a first mechanism (DS, M2) arranged to pivot the fourth link so as to move the second link and thereby pivot the third link about the third pivot point to move the press tool and then to hold the position of the fourth link with the first, second, third and fourth pivot points having generally the configuration of a parallelogram; and a second mechanism (DS, C, L5) arranged to pivot the first link about the first fixed pivot point to move the press tool.

2. A press as claimed in claim 1, wherein the first and second mechanisms are synchronised so that, when the first mechanism is arranged to hold the position of the fourth link, the second mechanism is arranged to pivot the first link about the first fixed pivot point to move the press tool.

3. A press as claimed in claim 1 or 2, wherein, when the first to fourth pivot points have the generally parallelogram configuration, the press tool is movable by the second mechanism from an initial pressing position to a final pressing position in which the line from the first to third pivot points forms an angle relative to the horizontal of substantially 0 to 40°.

4. A press as claimed in claim 3, wherein the angle is substantially 0 to 30°.

5. A press as claimed in claim 3, wherein the angle is substantially 0 to 15°.

6. A press as claimed in claim 3, wherein the angle is substantially 0°.

7. A press as claimed in any preceding claim, wherein the fourth link has a first cam element (M1) and the first mechanism comprises a second cam element (M2) for driving the first cam element.

8. A press as claimed in claim 7, wherein the first cam element is a cam follower, and the second cam element is a cam rotatable about a cam axis and having a first portion (80) of cam surface of varying radius relative to the cam axis for pivoting the fourth link and a second portion (81) of cam surface of substantially constant radius relative to the cam axis for holding the position of the fourth link.

9. A press as claimed in claim 8, wherein the cam has a third portion (82) of cam surface of varying radius relative to the cam axis for partially or totally reversing the pivoting of the fourth link caused by the first portion of cam surface.

10. A press as claimed in any preceding claim, wherein the fourth link is a lever.

11. A press as claimed in claim 10, wherein the fourth link is a second order lever.

12. A press as claimed in any preceding claim, wherein the second mechanism comprises a fifth link (L5) pivoted to the first link at a sixth pivot point (P6) and a crank (C) pivoted to the fifth link at a seventh pivot point (P7) and rotatable about a crank axis.

13. A press as claimed in any preceding claim, where the first link is a lever.

14. A press as claimed in claim 13, wherein the first link is a first order lever.

15. A press as claimed in claim 14, wherein the first link is a bell crank lever.

16. A press as claimed in any preceding claim, wherein the first and second mechanisms are driven by a common drive shaft (DS).

17. A press as claimed in claim 16, wherein the drive shaft is driven by an electric motor (54).

18. A press comprising:

a first generally-horizontal link (L1) below a second generally-horizontal link (L2);

a third link (L3) extending down from the second link to the first link and carrying a press tool (70) with a generally downwardly facing working surface;

a fourth link (L4) arranged to be driven by a first mechanism (DS, M2) to push the second link and thus the press tool generally forwards from a horizontally retracted start position to a horizontally advanced initial pressing position, after which the first mechanism is arranged to hold the position of the fourth link; and a second mechanism (DS, C, L5) arranged, when the position of the fourth link is being held, to pivot the first link to drag downwards the third link and thus drag the press tool generally downwards from the initial pressing position to a vertically lower final pressing position.

* * * * *